US008995895B2

(12) United States Patent
Yabuki

(10) Patent No.: US 8,995,895 B2
(45) Date of Patent: Mar. 31, 2015

(54) FIXING APPARATUS FOR AN IMAGE FORMING APPARATUS

(71) Applicant: Oki Data Corporation, Tokyo (JP)

(72) Inventor: Makoto Yabuki, Minato-ku (JP)

(73) Assignee: Oki Data Corporation, Tokyo (JP)

( * ) Notice: Subject to any disclaimer, the term of this patent is extended or adjusted under 35 U.S.C. 154(b) by 60 days.

(21) Appl. No.: 13/853,476

(22) Filed: Mar. 29, 2013

(65) Prior Publication Data

US 2013/0259547 A1 Oct. 3, 2013

(30) Foreign Application Priority Data

Mar. 30, 2012 (JP) ..... 2012-081842

(51) Int. Cl.
*G03G 15/20* (2006.01)

(52) U.S. Cl.
CPC ..... *G03G 15/2089* (2013.01); *G03G 15/2028* (2013.01); *G03G 15/206* (2013.01)
USPC ..... 399/329

(58) Field of Classification Search
CPC ..... G03G 15/2089; G03G 15/2064; G03G 15/2067; G03G 2215/2009
USPC ..... 399/329, 328
See application file for complete search history.

(56) References Cited

U.S. PATENT DOCUMENTS

| | | | | |
|---|---|---|---|---|
| 7,953,361 | B2 * | 5/2011 | Obata et al. | 399/329 |
| 2005/0185996 | A1 * | 8/2005 | Oishi et al. | 399/329 |
| 2009/0052925 | A1 * | 2/2009 | Fujimoto | 399/329 X |
| 2012/0057910 | A1 * | 3/2012 | Matsumoto | 399/329 |
| 2012/0070173 | A1 * | 3/2012 | Arakawa | 399/329 X |
| 2013/0084088 | A1 * | 4/2013 | Sakai | 399/329 X |

FOREIGN PATENT DOCUMENTS

| | | |
|---|---|---|
| JP | 2005-275371 A | 10/2005 |
| JP | 2006-003537 A | 1/2006 |
| JP | 2008-158049 A | 7/2008 |

OTHER PUBLICATIONS

Machine translation of JP 2008-158049 (published on Jul. 10, 2008) dated Aug. 5, 2014.*

* cited by examiner

*Primary Examiner* — Sophia S Chen
(74) *Attorney, Agent, or Firm* — Pantich Schwarze Belisario & Nadel LLP

(57) ABSTRACT

A fixing member is rotatably supported. A first pressing member faces the fixing member. A running member runs while being sandwiched between the fixing member and the first pressing member. A first mechanism urges the first pressing member against the fixing member, defining a first nip between the fixing member and the running member. A second pressing member presses the running member against the fixing member. A second mechanism includes a holding member that holds the second pressing member and an urging member therein, and urges the second pressing member against the fixing member with the running member sandwiched therebetween, defining a second nip, adjacent to the first nip, between the fixing member and the running member. The second pressing member and the holding member abut each other through a plurality of projections formed on at least one of the second pressing member and second pressing mechanism.

19 Claims, 14 Drawing Sheets

FIXING APPARATUS FOR AN IMAGE FORMING APPARATUS

BACKGROUND OF THE INVENTION

1. Field of the Invention

The present invention relates to a fixing apparatus and an image forming apparatus that incorporates the fixing apparatus.

2. Description of the Related Art

Conventional image forming apparatus include printers, copying machines, facsimile machines, and multifunction peripherals. For example, an electrophotographic printer includes a charging roller, a photoconductive drum, a light emitting diode (LED) head, a developing roller, and a transfer roller. The charging roller uniformly charges the surface of the photoconductive drum. The LED head illuminates the charged surface of the photoconductive drum to form an electrostatic latent image in accordance with print data. The developing roller supplies a thin layer of toner to the electrostatic latent image as the photoconductive drum rotates, thereby developing the electrostatic latent image with the toner into a toner image. The transfer roller transfers the toner image onto print paper. After transfer, the print paper passes through a fixing unit so that the toner image on the print paper is fixed into a permanent image by heat and pressure. The print paper is then discharged onto a stacker.

One such printer is disclosed in Japanese Patent Application No. 2005-275371 and employs a belt-nip fixing unit in which a pressure pad is pressed against a fixing roller with an endless belt sandwiched between the pressure pad and the fixing roller.

FIG. 12 is a cross-sectional view of a conventional belt-nip fixing unit 101.

The fixing unit 101 includes a pressure belt assembly 102 and a fixing roller 103. The pressure belt assembly 102 includes a pressure roller 104, a pressure belt 105, a pressure pad 106, a spring 107, and a holder 108. The spring 107 urges the pressure pad 106 against the fixing roller 103 with the pressure belt 105 sandwiched between the pressure pad 106 and the fixing roller 103. The holder 108 holds the pressure pad 106 in position. The pressure pad 106 is supported such that the pressure pad 106 is slidable on the inner surface of the pressure belt 105 and can extend and retract within the holder 108 relative to the fixing roller 103. A heater 109 is disposed inside the fixing roller 103.

A nip N3 is formed between the fixing roller 103 and the pressure belt assembly 102. When the print paper carrying a toner image thereon passes through the nip N3, the toner image is fused by heat and is pressed by the pressure belt assembly 102, thereby being fixed into the print paper.

The conventional fixing unit 101 suffers from a problem in that when the pressure belt 105 runs, a friction resistance is developed between the inner surface of the pressure belt 105 and the upper surface of the pressure pad 106, and in that the friction resistance may cause the pressure pad 106 to decline, vibrate, or rattle. This may result in seizure of the pressure pad 106 within the holder 108, the pressure pad 106 becoming unable to reliably urge the pressure belt 105 against the fixing roller 103. The unstable urging force of the pressure pad 106 causes poor print quality such as disturbance, shifting, uneven quality of image or increases the load on the fixing motor (not shown) that drives the fixing roller 103 in rotation, or may cause complete stoppage of the fixing unit 101.

SUMMARY OF THE INVENTION

An object of the present invention is to solve the aforementioned drawbacks of the conventional fixing unit and to provide a fixing unit capable of pressing a pressure member against a fixing member while also preventing image quality from degrading or the fixing unit from stopping.

A fixing apparatus is capable of pressing a pressure member against a fixing member while also preventing image quality from degrading or the fixing unit from stopping.

A fixing member is rotatably supported. A first pressing member is disposed to face the fixing member. A running member is sandwiched between the fixing member and the first pressing member, and runs when the fixing member rotates. A first pressing mechanism urges the first pressing member against the fixing member so that a first nip is defined between the fixing member and the running member. A second pressing member is disposed to face the fixing member with the running member sandwiched between the fixing member and the second pressing member. A second pressing mechanism urges the second pressing member against the fixing member with the running member sandwiched between the fixing member and the second pressing member so that a second nip is defined between the fixing member and the running member. The second nip is adjacent to the first nip. The second pressing mechanism includes a holding member that holds the second pressing member and an urging member therein. The urging member urges the second pressing member against the fixing member. The second pressing member and the holding member abut each other through a plurality of projections.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail by way of preferred embodiments with reference to the accompanying drawings. The embodiments will be described in terms of a printer as an image forming apparatus.

First Embodiment

{Configuration of Image Forming Apparatus}

Figure 1:
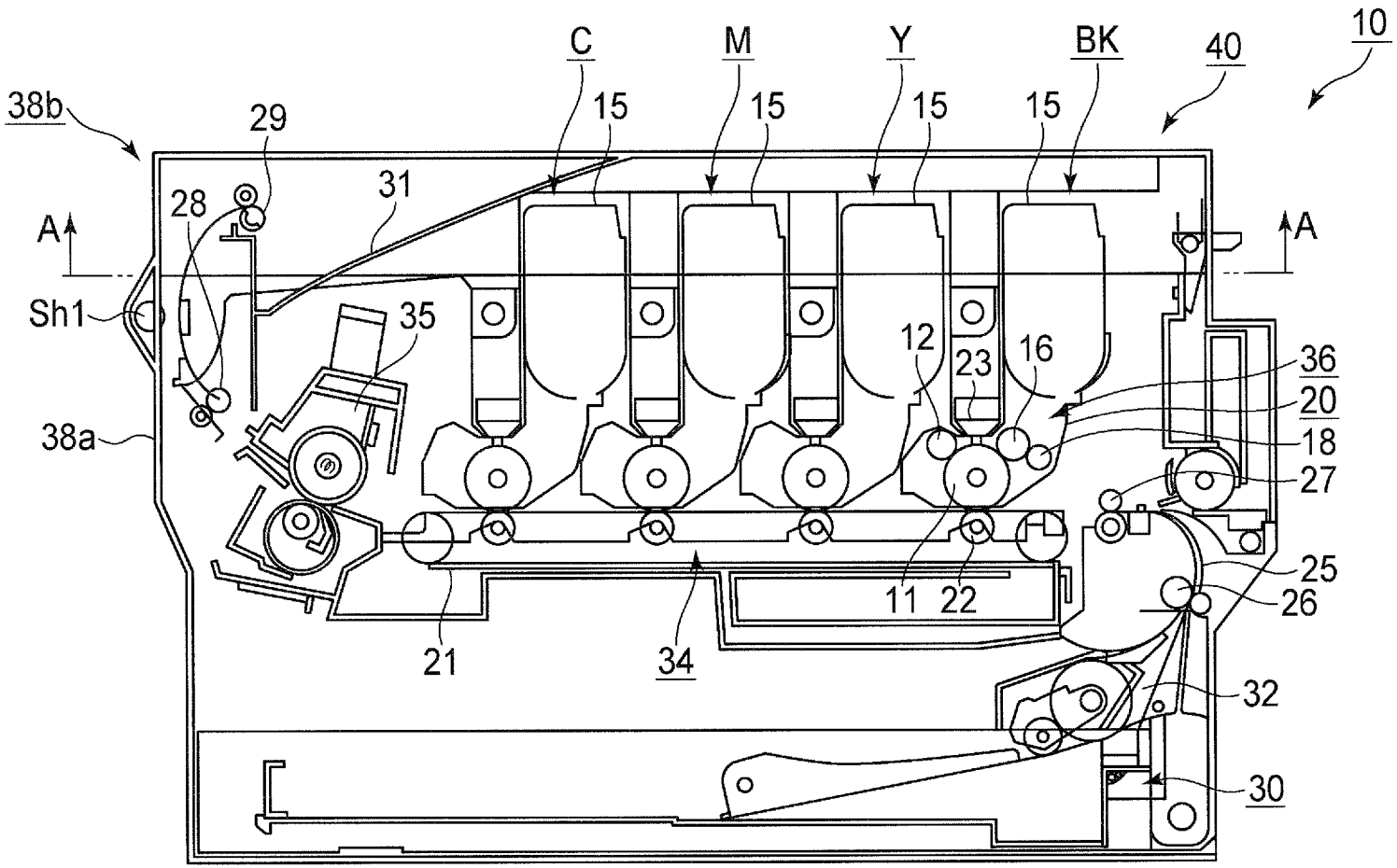
FIG. 1 illustrates a printer according to a first embodiment.

FIG. 1 illustrates a printer 10 as an image forming apparatus according to a first embodiment.

The printer 10 includes a body 40, image forming units, a transport path 25 in which print paper (not shown) as a print medium is transported, and transport rollers 26-29 in the transport path 25. The image forming units (ID units) Bk, Y, M, and C that form black, yellow, magenta, and cyan images, respectively, are aligned along the transport path 25.

A belt nip fixing unit 35 is disposed downstream of the image forming units BK, Y, M, and C, and fixes a toner image on the print paper by heat and pressure.

Each of the image forming units BK, Y, M, and C may be substantially identical; for simplicity, only the image forming apparatus BK will be described, it being understood that other image forming units Y, M, and C may work in a similar fashion.

The image forming unit BK includes a photoconductive drum 11, an LED head 23, and a developing unit 36. A charging roller 12 rotates in pressure contact with the photoconductive drum 11 in a direction opposite to the photoconductive drum 11, and uniformly charges the surface of the photoconductive drum 11. An LED head 23 is disposed above the photoconductive drum 11 and parallels the photoconductive drum 11. The LED head 23 illuminates the charged surface of the photoconductive drum 11 to form an electrostatic latent image (not shown) . A transfer unit 34 is disposed under the image forming units BK, Y, M, and C, and transfers the toner images of the respective colors onto the print paper. The transfer unit 34 is driven to run by a belt driving mechanism.

A developing unit 36 includes a developing roller 16, a developing blade (nth sown), and a toner supplying roller 18. The developing roller 16 supplies toner to the electrostatic latent image formed on the photoconductive drum 11. The developing blade forms a thin layer of the toner on the developing roller 15. The toner supplying roller 18 supplies the toner to the developing roller 16. The developing roller 16 is in pressure contact with the photoconductive drum 11, and rotates in an opposite direction to the photoconductive drum 11. The toner supplying roller 18 is in pressure contact with the developing roller 16, and rotates in the same direction as the developing roller 16. The photoconductive drum 11, developing roller 16, toner supplying roller 18, LED head 23 and charging roller 12 and so on form a print engine.

The photoconductive drum 11, charging roller 12, and developing unit 36 are housed in a body of the image forming unit 20. A toner cartridge 15 is detachably attached to the top of the image forming unit 20.

The transfer unit 34 includes a transfer belt 21 and transfer rollers 22. The transfer belt 21 is disposed about the transfer rollers 22 so that the transfer belt 21 is sandwiched between the photoconductive drum 11 and the transfer rollers 22. The transfer belt 21 carries the print paper thereon, and runs through the image forming units 20. The transfer belt 21 and transfer rollers 22 receive voltage from a power supply (not shown) and transfer the toner image of the respective colors from the photoconductive drums onto the print paper in sequence.

The printer 40 includes a body 38*a* and a top cover 38*b* configured to pivot about a shaft Sh1 so that the top cover 38*b* can be opened and closed relative to the body 38*a*. When the top cover 38*b* is closed, the top cover 38*b* closes the upper opening of the body 38*a* depicted at a plane A-A. The top cover 38*b* includes a stacker 31 formed on an outer surface thereof, the stacker 31 receiving the discharged sheets of print paper thereon. A paper cassette 30 is located under the transfer unit 34, and holds a stack of sheet of paper. The paper feeding mechanism 32 is disposed in the vicinity of the paper cassette 30, and feeds the print paper into the transport path on a sheet-by-sheet basis.

{Operation of Image Forming Apparatus}

The operation of the printer 10 of the aforementioned configuration will be described.

The charging roller 12 charges the surface of the photoconductive drum 11. The LED head 23 illuminates the charged surface of the photoconductive drum 11 in accordance with the print data to form an electrostatic latent image. The developing unit 36 supplies the toner to the electrostatic latent image, thereby developing the electrostatic latent image with the toner to form a toner image.

The paper feeding mechanism feeds the sheets of print paper from the paper cassette 30 on a sheet-by-sheet basis, the sheet being transported by the transport rollers 26 and 29 to the transfer belt 21. The print paper is attracted to the transfer belt 21 by Coulomb force. As the transfer belt 21 runs through the respective image forming units BK, Y, M, and C in sequence, the toner images of the respective colors are transferred onto the print paper in registration, thereby transferring a full-color toner image onto the print paper. The print paper then advances to the fixing unit 35 where the full-color toner image is fixed into the print paper by heat and pressure. After fixing, the print paper is further transported by the transport rollers 28 and 29 and is discharged onto the stacker 31.

The printer 10 includes an interface and a controller. The interface communicates print data with an external apparatus (not shown). The controller performs the overall control of the printer 10.

{Fixing Unit}

The fixing unit 35 will now be described.

Figure 2:
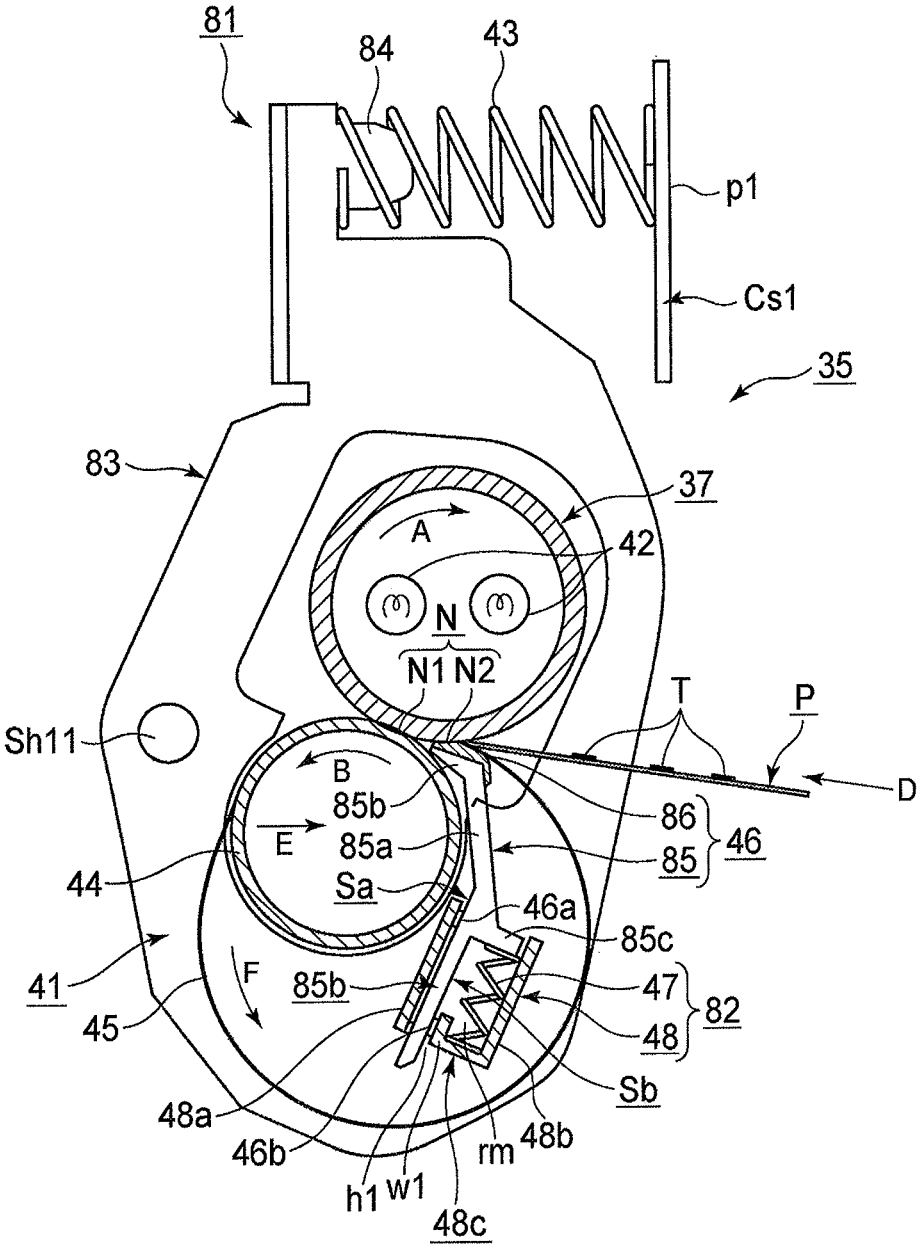
FIG. 2 is a cross-sectional view of a fixing unit according to the first embodiment.

FIG. 2 is a cross-sectional view of the fixing unit 35 according to the first embodiment. Referring to FIG. 2, the fixing unit 35 includes a fixing roller 37 as a heating member and a pressure belt assembly 41. The fixing roller 37 is rotatably supported by bearings (not shown) and is driven in rotation by a fixing motor (not shown). The fixing motor is disposed on the body 40, and serves as a drive source for the fixing roller 37. The fixing roller 37 rotates at a predetermined circumferential speed in a direction shown by arrow A. A drive gear (not shown) is attached to an output shaft of the fixing motor. A driven gear (not shown) is attached to one longitudinal end portion of the fixing roller 37. The drive gear is in mesh with the driven gear, thereby transmitting the drive force to the fixing roller 37.

The fixing roller 37 is a hollow roller having an outer diameter of about 28 mm, and includes a core metal formed of iron, covered with silicone rubber. A heat resistant, elastic layer having a thickness of 1.2 mm is formed on the silicone rubber. A toner releasing layer is formed of fluoroplastic with a thickness of 41 μm, and covers the heat resistant, elastic layer. The core metal may also be formed of other metal, e.g., aluminum.

The fixing roller 37 includes built-in heaters 42. The heaters 42 are energized by a power source (not shown). A thermistor (not shown) is disposed in the vicinity of the surface of the fixing roller 37, and serves as a temperature sensor. The thermistor detects the surface temperature of the fixing roller 37, and feeds the sensor output signal to a temperature control circuit (not shown). The heater 42 may be implemented with a halogen lamp or an induction heater.

A pressure belt assembly 41 includes a pressure roller 44 that rotates in a direction shown by arrow B, a pressure belt 45, a pressure pad 46, an urging mechanism 81, and an urging mechanism 82. The pressure belt 45 is an endless belt, and runs in contact with the fixing roller 37 in a direction shown by arrow F. The pressure pad 46 is disposed upstream of the pressure roller 44 with respect to the direction in which the pressure belt 45 runs, and serves as a second pressure member. The urging mechanism 81 serves as a first urging mechanism that urges the pressure roller 44 against the fixing roller 37 with the pressure belt 45 sandwiched between the pressure roller 44 and the fixing roller 37. The urging mechanism 82 is mounted on the body 40 of the printer 10 and serves as a second pressure mechanism, urging the pressure pad 46 against the fixing roller 37 with the pressure belt 45 sandwiched between the fixing roller 37 and the pressure pad 46.

The pressure belt 45 is disposed about the pressure roller 44, pressure pad 46, and urging mechanism 82 . The pressure roller 44 and pressure pad 46 are urged against the fixing roller 37 with the pressure belt 45 sandwiched between the pressure roller 44 and the pressure pad 46. A nip N is formed between the pressure belt 45 and the fixing roller 37 so that when the print paper P passes through the nip N, the color toner image is fused by heat and pressure. As the fixing roller 37 rotates, the pressure belt 45 is rotated in the C direction due to the friction between the pressure belt 45 and the fixing roller 37, thereby transporting the print paper P.

The pressure roller 44 is a hollow roller having an outer diameter of about 23 mm, and includes a core metal formed of iron covered with silicone rubber. A covering layer formed on the core metal is formed of fluoroplastic has a thickness of 20 μm. The core metal may also be formed of other metal, e.g., aluminum.

The pressure belt 45 has a two-layer structure, and includes a diameter of about 41 mm and a thickness of about 90 μm. The two-layer structure includes a base layer formed of polyimide as a heat resistant resin and a toner releasing layer formed of perfluoroalkoxy alkane (PFA) and having a thickness of about 20 μm.

The urging mechanism 81 is disposed at each longitudinal end portion of the pressure roller 44, and includes a spring 43 and a pressure lever 83. The pressure lever 83 is rotatably supported on the shaft Sh11 so that the pressure lever 83 is rotatable relative to the chassis Cs1 of the fixing unit 35. The spring 43 urges the pressure lever 83 counter clockwise. The spring 43 is mounted across an engagement portion 84 formed at a distance from the shaft Sh11 and a pressing portion P1 on the chassis Cs1. The spring 43 according to the first embodiment takes the form of a coil spring.

The pressure roller 44 is supported by bearings (not shown) and is rotatable relative to the pressure lever 83. When the spring 43 urges the pressure lever 83 to rotate counterclockwise about the shaft Sh11, the pressure roller 44 is firmly pressed against the fixing roller 37. As a result, a first nip N1 is formed on a portion of the pressure belt 45 in contact with the fixing roller 37.

In the first embodiment, the fixing roller 37 includes a heat resistant, elastic layer while the pressure roller 44 does not include a heat resistant, elastic layer but has a higher hardness than the fixing roller 37. Therefore, the fixing roller 37 elastically deforms at the first nip N1, thereby preventing the print paper P from wrapping around the fixing roller 37 to release the print paper P reliably.

The shaft Sh11 is located downstream of the nip N1 with respect to the direction of travel (arrow D) of the print paper P, and is adjacent to the pressure roller 44. The line passing through the rotational axes of the urging mechanism 83 and the pressure roller 44 is substantially perpendicular to the line passing through the rotational axes of the fixing roller 37 and the pressure roller 44.

The pressure pad 46 includes a base member 85, an elastic layer 86 and a low friction layer (not shown) formed on the elastic layer 86. The elastic layer 86 serves as a heat resistant, elastic layer formed at the tip of the base member 85. The pressure pad 46 holds the low friction layer in contact with the loop-like pressure belt 45 from inside so that the low friction layer is in position in the direction of travel of the print paper P. The pressure pad 46 is extendable and retractable relative to the fixing roller 37.

The base member 85 extends in such a direction as to go away from the reader and is formed in a two-stage process. A metal material, e.g., aluminum is subjected to drawing process or extrusion process, and then to press working. The elastic layer 86 is formed of silicone rubber, and has a hardness of 15 to 41 degrees when measured according to JIS-A, and a thickness of about 1 mm. The low friction layer covers the elastic layer 86 in order to reduce the friction between the inner surface of the pressure belt 45 and the elastic layer 86. The low friction layer is formed of a silicone material containing graphite, and has a thickness of 20 μm.

A longitudinally extending base member 85 includes an upper half portion 85*a* and a plurality of lower half portions 85*d* aligned along the upper half portion 85*a*. The lower half portions 85*d* extend downwardly from the upper half portion 85*a*. A pressing portion 85*b* extends from the upper end portion of the upper half portion 85*a* toward the first nip N1, and has a substantially triangular cross section. An abutting portion 85*c* extends from the middle portion of the base member 85 in such a direction as to go away from the base member 85, upstream of the base member 85 with respect to the direction of travel of the print paper P. The elastic layer 86 is disposed on the pressing portion 85*b*, substantially all over the upper surface of the pressing portion 85*b*.

The urging mechanism 82 includes a holder 48 and springs 47. The holder 48 holds the pressure pad 46 so that the pressure pad 46 parallels the fixing roller 37 and is extendable and retractable relative to the fixing roller 37. The springs 47 are aligned along the holder 48 and urge the pressure pad 46 against the fixing roller 37, thereby creating a second nip N2 in an area of the pressure pad 46 in contact with the fixing roller 37. The second nip N2 is adjacent to the first nip N1.

The springs 47 may also take the form of a resilient body or a driver member that causes the pressure pad 46 to extend and retract relative to the fixing roller 37.

Figure 3:
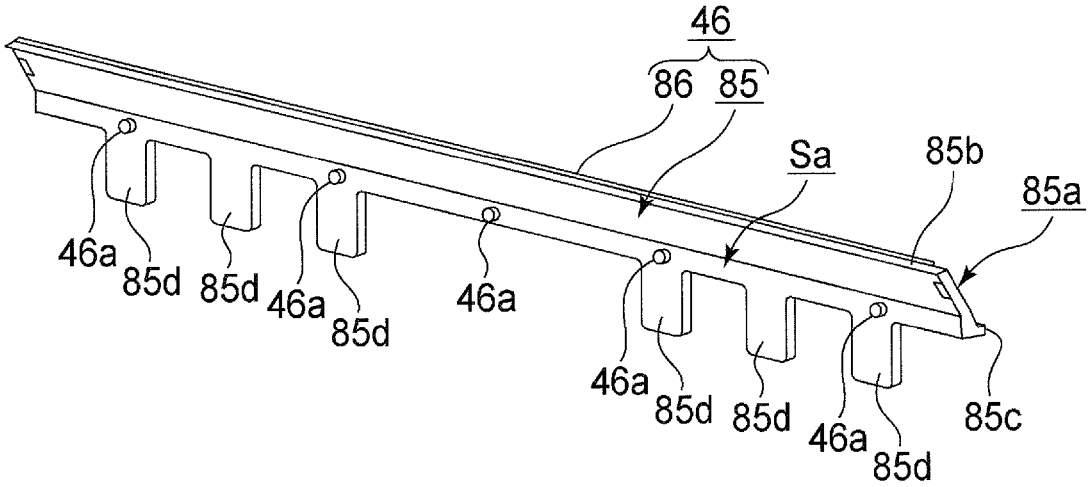
FIG. 3 is a rear perspective view, illustrating the rear of a pressure pad as seen substantially in a direction shown by arrow E in FIG. 2.
Figure 4:
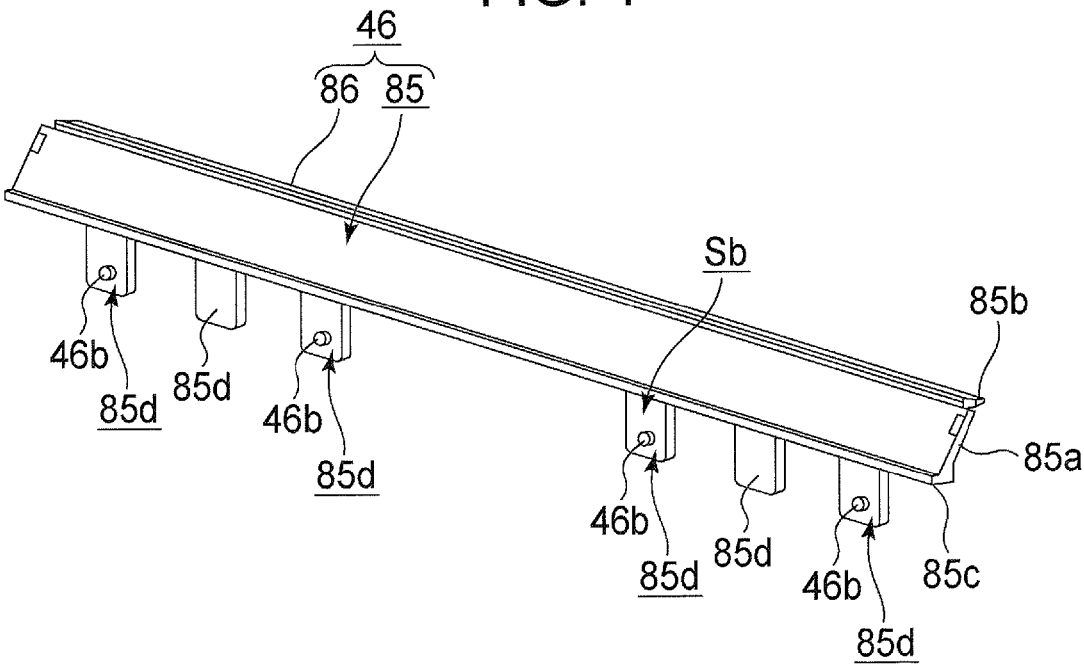
FIG. 4 is a perspective view illustrating the front of the pressure pad as seen substantially in the opposite direction to arrow E.

FIG. 3 is a rear perspective view illustrating the rear of a pressure pad 46 as seen substantially in a direction shown by arrow E in FIG. 2. FIG. 4 is a perspective view illustrating the front of the pressure pad as seen substantially in the opposite direction to arrow E.

Referring to FIG. 3, a plurality of cylindrical projections 46*a* are formed in one piece construction with the base member 85 on a surface Sa of the base member 85 that faces the inner wall 48*a* of the holder 48. A plurality of projections 46*b* (second projections) are formed on a surface Sb of the lower half portion 85*d* that faces the wall w1. The projections 46*a* are slidable on the inner wall 48*a*, and the projections 46*b* are slidable on the wall w1. The projections 46*a* and 46*b* are formed by pressing work.

Figure 5A:
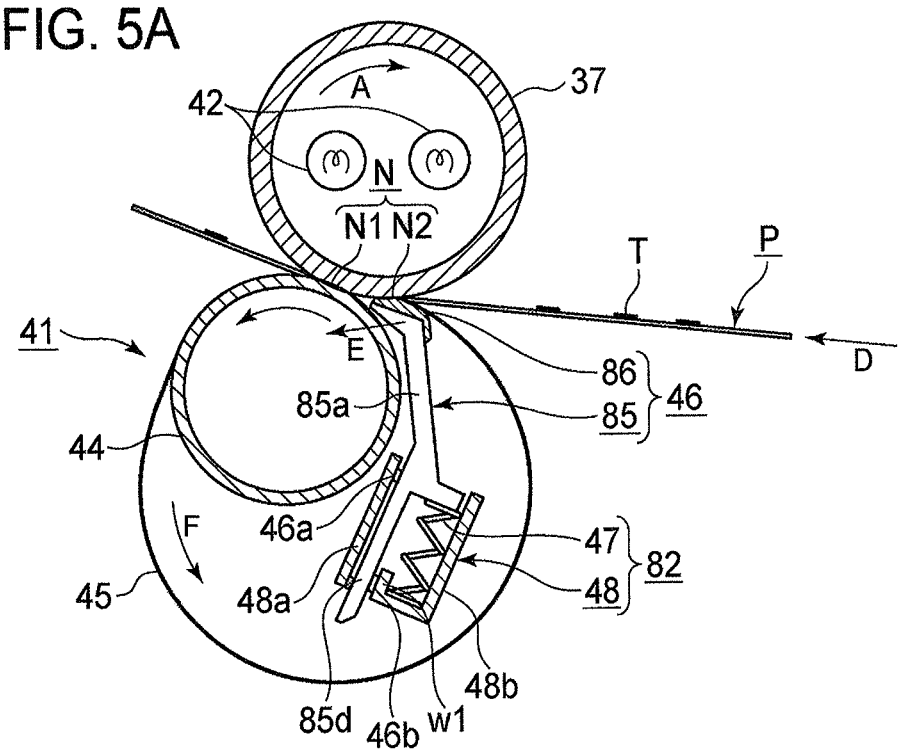
FIG. 5A illustrates the operation of the fixing unit according to the first embodiment.
Figure 5B:
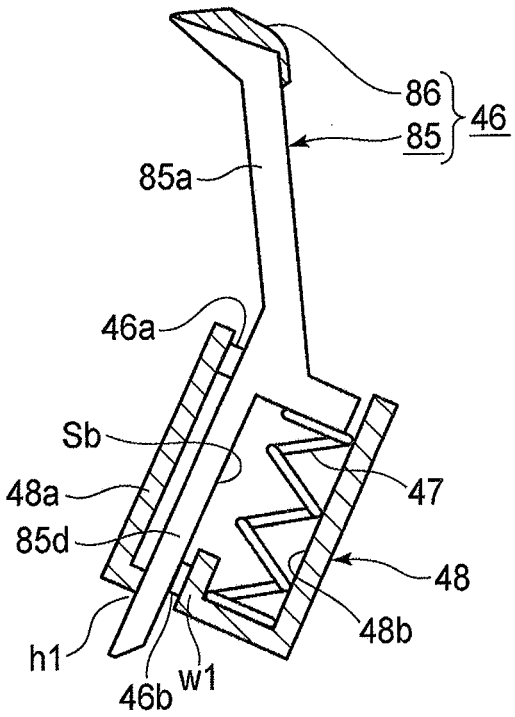
FIG. 5B illustrates a pertinent portion of the fixing unit.

FIG. 5A illustrates the operation of the fixing unit 35 according to the first embodiment. FIG. 5B illustrates a pertinent portion of the fixing unit.

Referring to FIGS. 5A and 5B, the holder 48 is formed of a metal material and has a gutter-like hollow body which has a generally U-shaped cross section and is open at its upper end. The holder 48 is mounted on the chassis of the printer 10 and is disposed close to the pressure roller 44. The holder 48 receives the abutting portion 85*c* and the lower half portions 85*d* therein so that the abutting portion 85*c* and the lower half portions 85*d* are slidable on the inner walls 48*a* and 48*b*, and 48*c*. The inner walls 48*a*, 48*b*, and 48*c* define a room rm that accommodates the abutting portion 85*c*, lower half portions 85*d*, and the springs 47 therein. The springs 47 are disposed between a bottom wall 48*c* and the abutting portion 85*c*.

Holes h1 are formed in the bottom wall 48*c* near the inner wall 48*a*, allowing the lower half portions 85*d* to extend through the holes h1. A wall w1 rises from the bottom wall 48*c* to cooperate with the inner wall 48*a* to define a groove therebetwen.

Since the base member 85 and holder 48 are formed of metal materials, the holder 48 may be connected to the ground so that the charges on the base member 85 are dissipated and the base member 85 is prevented from acting as an antenna that radiates electrical noise.

As the pressure belt 45 runs in the C direction, a frictional resistance is developed between the inner surface of the pressure belt 45 and the elastic layer 86, which causes the pressure pad 46 to incline, vibrate, or rattle. When the pressure pad 46 inclines, vibrates, or rattles, the lower half portions 85*d* of the pressure pad 46 and the inner wall of the holder 48 move into contact with each other.

Excessive temperatures of the pressure pad 46 and the holder 48 will lead to increased friction at their interface, which may result in seizure of the pressure pad 46 in a high temperature environment and fail to reliably urge the pressure pad 46 against the fixing roller 37. The seizure of the pressure pad 46 causes damaged images, positional shifts of images, and uneven image quality, leading to deteriorated image quality, increasing the load on the fixing motor, or even causing complete stoppage of the fixing unit.

Referring to FIG. 5B, when the pressure pad 46 abuts the projections 46*a* and the pressure mechanism 82 abuts the projections 46*b*, and the pressure pad 46 extends and retracts relative to the pressure belt 45, the projections 46*a* slide on the inner wall 48*a* and the projections 46*b* slide on the wall w1.

In the first embodiment, the lower half portions 85*d* and projections 46*a* and 46*b* are formed along the upper half portion 85*a* in a direction perpendicular to the direction of travel of the print paper P. The number of the lower half portions 85*d* and projections 46*a* and 46*b* may be selected so that the printer 10 is capable of printing on the print paper P of a variety of sizes including A5, A4 and A3 sizes.

Figure 6:
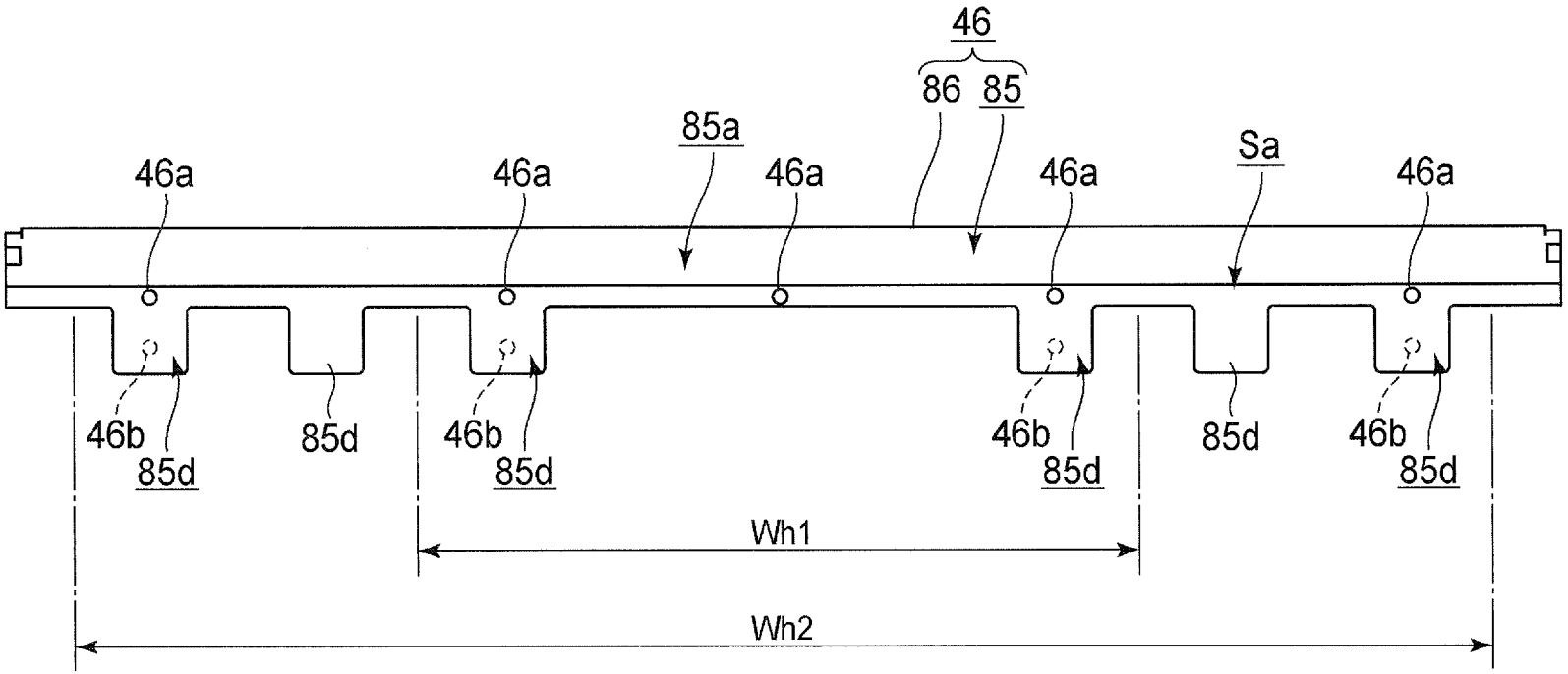
FIG. 6 is a rear view of the pressure pad according to the second embodiment.

FIG. 6 is a rear view of the pressure pad. The printer 10 according to the present invention supports A5, A4, and A3 size paper. The A5 size print paper P has a width Wh1 (148 mm) and the A3 size print paper P has a width Wh2 (297 mm). Two laterally centered first lower half portions 85*d* are disposed within the width Wh2. Two laterally centered second lower half portions 85*d* are disposed between the two laterally centered first lower half portions 85*d*. Two laterally centered third lower half portions 85*d* are disposed between the two laterally centered second lower half portions 85*d*. One projection 46*a*, shown in solid line, is formed substantially at the longitudinal middle of the upper half portion 85*a*. Each of four projections 46*a*, shown in solid lines, is formed on the surface Sa immediately above a corresponding one of the first and third lower half portions 85*d*. Each of four projections 46*b*, shown in dotted lines, is formed on the surface Sb of a corresponding one of the first and third lower half portions 85*d*. When printing is performed on A5 size paper, the A5 size paper is advanced in the area Wh1. When printing is performed on A3 size paper, the A3 size paper is advanced in the area Wh2.

The projections 46*a* and 46*b* have been described in terms of a cylindrical shape but may take the form of a rib.

{Operation of Fixing Unit}

The operation of the fixing unit 35 will be described with reference to FIGS. 5A and 5B.

When the printer 10 starts printing, the fixing motor is energized to drive the fixing roller 37 into rotation, the fixing roller 37 causing the pressure belt 45 to run by means of the frictional force developed at the nip N between the pressure belt 45 and the fixing roller 37.

The heaters 42 are energized by the power supply to generate heat, which in turn heats the fixing roller 37 from inside. The power supply adjusts the amount of current supplied to the heater in accordance with the output of the thermistor, thereby controlling the temperature of the fixing roller 37 to a predetermined temperature.

When the temperature of the fixing roller 37 has reached the predetermined temperature, the print paper P is fed into the nip N. As the pint paper P passes through the nip, i.e., nips N1 and N2, the toner image T on the print paper P is fused by heat and pressure into a permanent image. After fixing, the print paper P is discharged outside the chassis Cs1 through a discharge port (not shown).

When the fixing roller 37 rotates in the A direction and the pressure belt 45 is driven to run in the C direction, a force acts on the pressure pad 46 in the E direction so that the pressure pad 46 inclines, causing the lower end portion 46*a* of the upper half portion 85*a* to press the inner wall 48*a*, and the lower end portion 46*b* of the lower half portion 85*d* to press the wall w1. Since the projections 46*a* and 46*b* have a small surface area, the contact area between the inner wall 48*a* and the upper half portion 85*a* and the contact area between the wall w1 and the lower half portion 85*d* are small.

When the print paper P is fed into the nip N, the pressure pad 46 retracts into the holder 48 in accordance with the thickness of the print paper P. At this time, the small contact areas between the pressure pad 46 and the holder 48 can be small enough.

As described above, the. projections 46*a* and 46*b* serve to reduce the contact area between the inner wall 48*a* and the projection 46*a*, and the contact area between the wall w1 and the projection 46*b*, reducing the frictional resistance developed between the pressure pad 46 and the holder 48.

As a result, seizure of the pressure pad 46 does not occur in the holder 48 even if the pressure pad 46 inclines, vibrates, or rattles. This helps the pressure pad 46 urge the fixing roller 37, preventing the printed image from suffering from damaged images, shifted images, and uneven image quality, leading to deteriorated image quality and increasing the load on the fixing motor or even complete stoppage of the fixing unit.

The projections 46*a* are formed on the lower end portion of the upper half portion 85*a* so that the area of the base member 85 in pressure contact with the wall 48*a* may be small and the projections 46*b* are formed on the lower end portion of the lower half portion 85*d* so that the area of the base member 85 in pressure contact with the inner wall w1 may be small. This minimizes the total contact area of the base member 85 with the holder 48 so that the frictional resistance between the pressure pad 46 and the holder 48 is small when the base member 85 extends and retracts within the holder 48.

The projections 46*a* may also be formed at arbitrary locations where the lower half portion 85*d* faces the inner wall 48*a*. Still alternatively, the projections 46*b* may be formed at arbitrary locations on the surface Sb (FIGS. 2 and 4) of the lower half portion 85*d*.

Also, instead of the projections 46*a* and 46*b*, projections may be formed either on the inner wall 48*a* and the wall w1 or on the base member 85, inner wall 48*a*, and wall w1.

Second Embodiment

Elements similar to those of the first embodiment have been given similar reference numerals and their description is omitted.

Figure 7A:
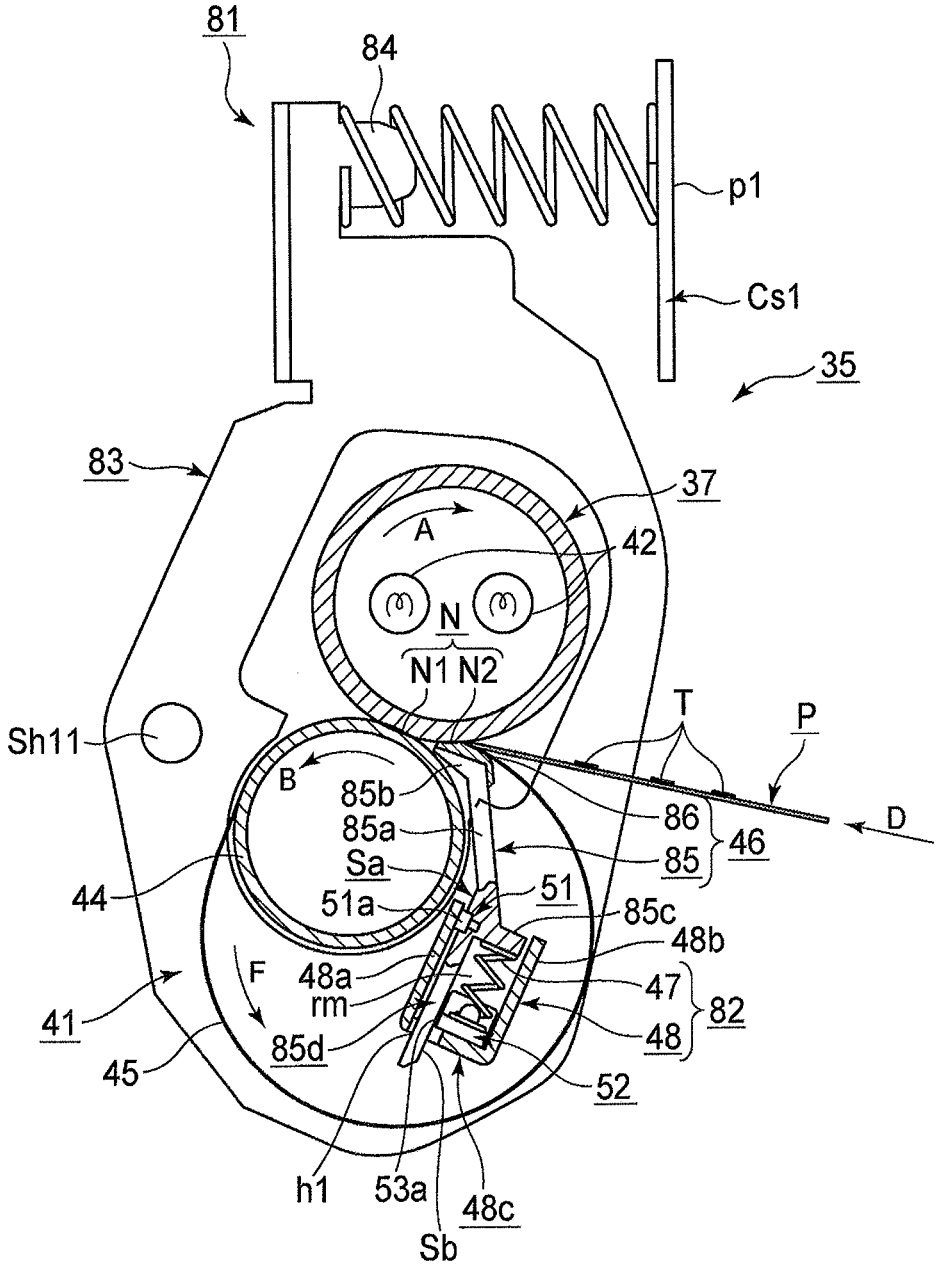
FIG. 7A is a cross-sectional view of a fixing unit according to a second embodiment.
Figure 7B:
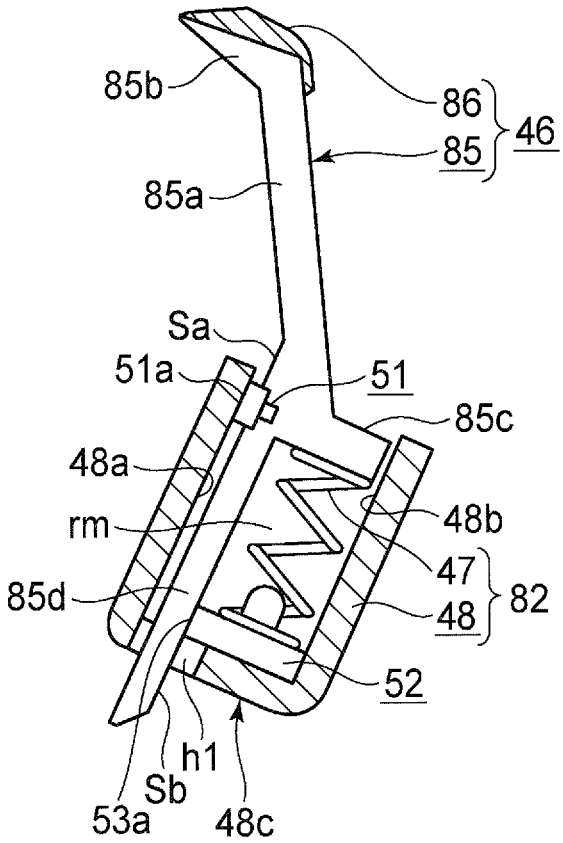
FIG. 7B is an expanded view of a pertinent portion of the fixing unit according to a second embodiment.
Figure 8A:
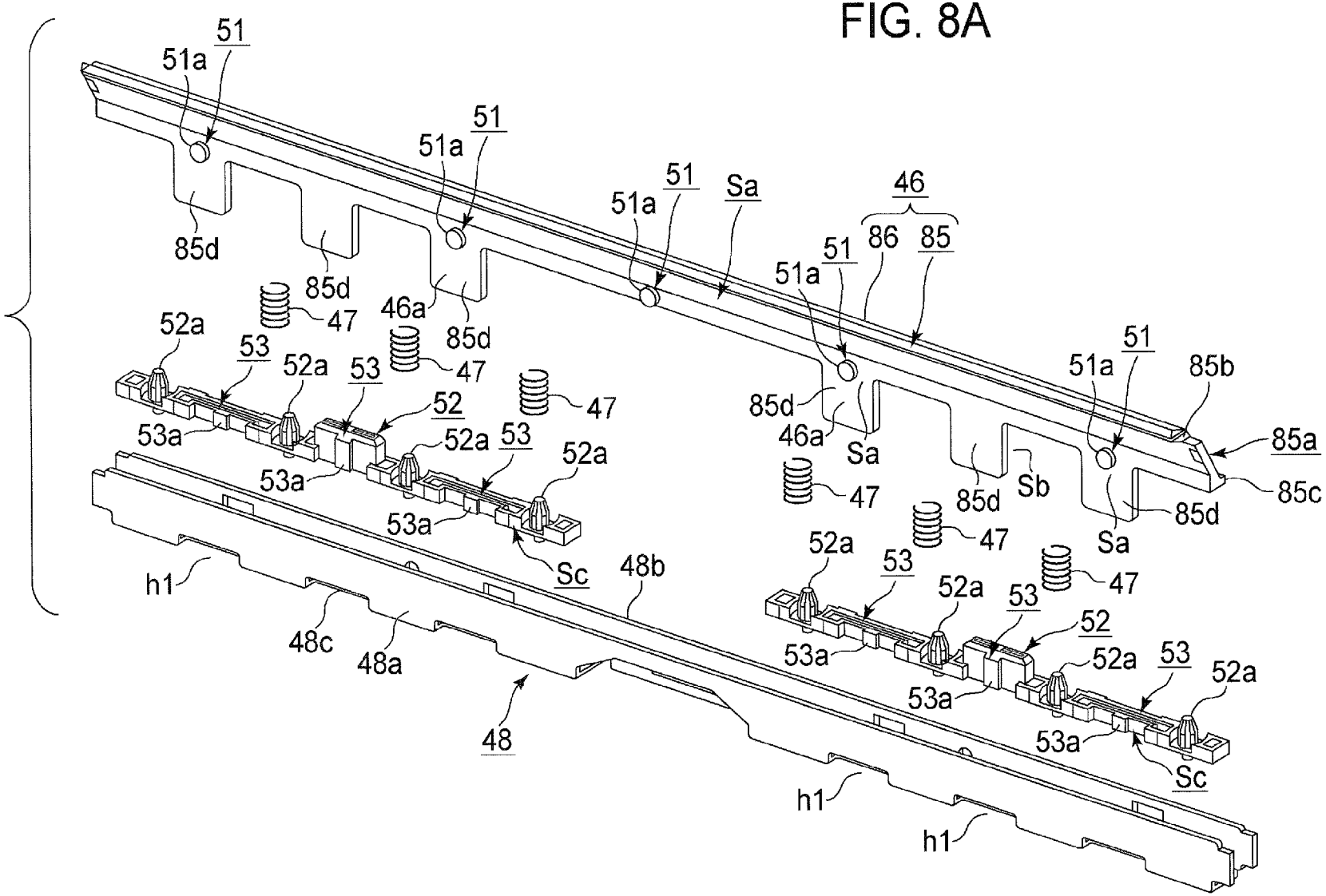
FIG. 8A is an exploded perspective view illustrating a pressure pad, springs, and a holder according to the second embodiment.

FIG. 7A is a cross-sectional view of a fixing unit according to a second embodiment. FIG. 7B is an expanded view of a pertinent portion of the fixing unit. FIG. 8A is an exploded perspective view illustrating a pressure pad, springs, and holder according to the second embodiment.

A longitudinally extending base member 85 includes an upper half portion 85*a*, a pressing portion 85*b*, an abutting portion 85*c*, and a plurality of lower half portions 85*d*. The lower half portions 85*d* extend downwardly from the upper half portion 85*a*. The pressing portion 85*b* extends from the upper end portion of the upper half portion 85*a* toward a first nip N1 and has a substantially triangular cross section. The abutting portion 85*c* horizontally extends from a middle portion of the base member 85 in such a direction as to go away from the base member 85, upstream of the base member 85 with respect to the direction of travel of the print paper P. A heat resistant, elastic layer 86 is disposed on the pressing portion 85*b* substantially all over the upper surface of the pressing portion 85*b*.

The urging mechanism 82 includes a holder 48 and springs 47. The holder 48 holds the pressure pad 46 therein so that the pressure pad 46 parallels the fixing roller 37 and is extendable and retractable relative to the fixing roller 37. The springs 47 are disposed in the holder 48 along the holder 48 and urge the pressure pad 46 against the fixing roller 37.

The holder 48 is formed of a metal material and has a gutter-like hollow body which has a generally U-shaped cross section and is open at its upper end. The holder 48 is disposed close to the pressure roller 44. The holder 48 receives the abutting portion 85*c* and the lower half portions 85*d* therein so that the abutting portion 85*c* and the lower half portions 85*d* are slidable on opposing inner walls 48*b* and 48*a*. The inner walls 48*a* and 48*b* and a bottom wall 48*c* define a room rm that accommodates the abutting portion 85*c*, the lower half portion 85*d*, and the springs 47 therein. The springs 47 are disposed between a bottom wall 48*c* and the abutting portion 85*c*.

Holes h1 are formed in the bottom wall 48*c* near the inner wall 48*a*, allowing the lower half portions 85*d* to extend therethrough. A wall w1 rises from the bottom wall 48*c*, cooperating with the inner wall 48*a* to define a narrow groove between the wall w1 and the inner wall 48*a* in which the lower half portions 85*d* are sandwiched and are slidable.

As the pressure belt 45 runs in the F direction, a frictional resistance is developed between the inner surface of the pressure belt 45 and the elastic layer 86, which causes the pressure pad 46 to incline, vibrate, or rattle. When the pressure pad 46 inclines, vibrates, or rattles, the lower half portions 85*d* of the pressure pad 46 and the inner wall of the holder 48 move into contact with each other.

Excessive temperatures of the pressure pad 46 and the holder 48 will lead to increased friction at their interface, which may result in seizure of the pressure pad 46 in a high temperature environment and fail to reliably urge the pressure pad 46 against the fixing roller 37.

In the second embodiment, a plurality of projections 51 are disposed on a surface Sa of the lower portion of upper half portion 85*a* facing the inner wall 48*a*. The projections 51 are a cylinder of a resin with a large diameter portion and a small diameter portion. The projections 51 are press-fitted into the surface Sa so that a surface 51*a* of the large diameter portion projects from the surface Sa.

Referring to FIG. 8A, the holder 48 accommodates abutting members 52 as a second sliding member, which are slidable in contact with the base member 85 and holds the base member 85 between the wall 48*a* and the abutting member 52. The abutting members 52 are formed of a resin material, and are disposed at a plurality of locations (two locations in the second embodiment) on the bottom wall 48*c* and beside the lower half portions 85*d*, and aligned in the longitudinal direction of the holder 48. Each of the abutting members 52 has four upwardly extending spring supporting projections 52*a*, and a spring 47 fits over a corresponding spring supporting projection 52*a*. Each spring 47 is disposed between the supporting projections 52*a* and the abutting portion 85*c*.

The abutting member 52 includes a surface Sc that faces the lower half portion 85*d* and is located between adjacent supporting projections 52*a*. A plurality of projections 53 are a cube or a rectangular parallelepiped of a resin material. The projections 53 are press-fitted into the surface Sc so that the projection 53 partially projects from the surface Sc. Projected surfaces 53*a* of the projections 53 project from the surface Sc and are in the shape of a rectangular parallelopiped. When the pressure pad 46 extends out of and retracts into the holder 48, the projections 51*a* slide on the inner wall 48*a* and the projected surfaces 53*a* slide on the lower portion of the lower half portion 85*d*.

In the second embodiment, the number of the lower half portions 85*d* and projections 51*a* and projected surfaces 53*a* is selected to support a variety of paper sizes including A5, A4, and A3 sizes.

Figure 8B:
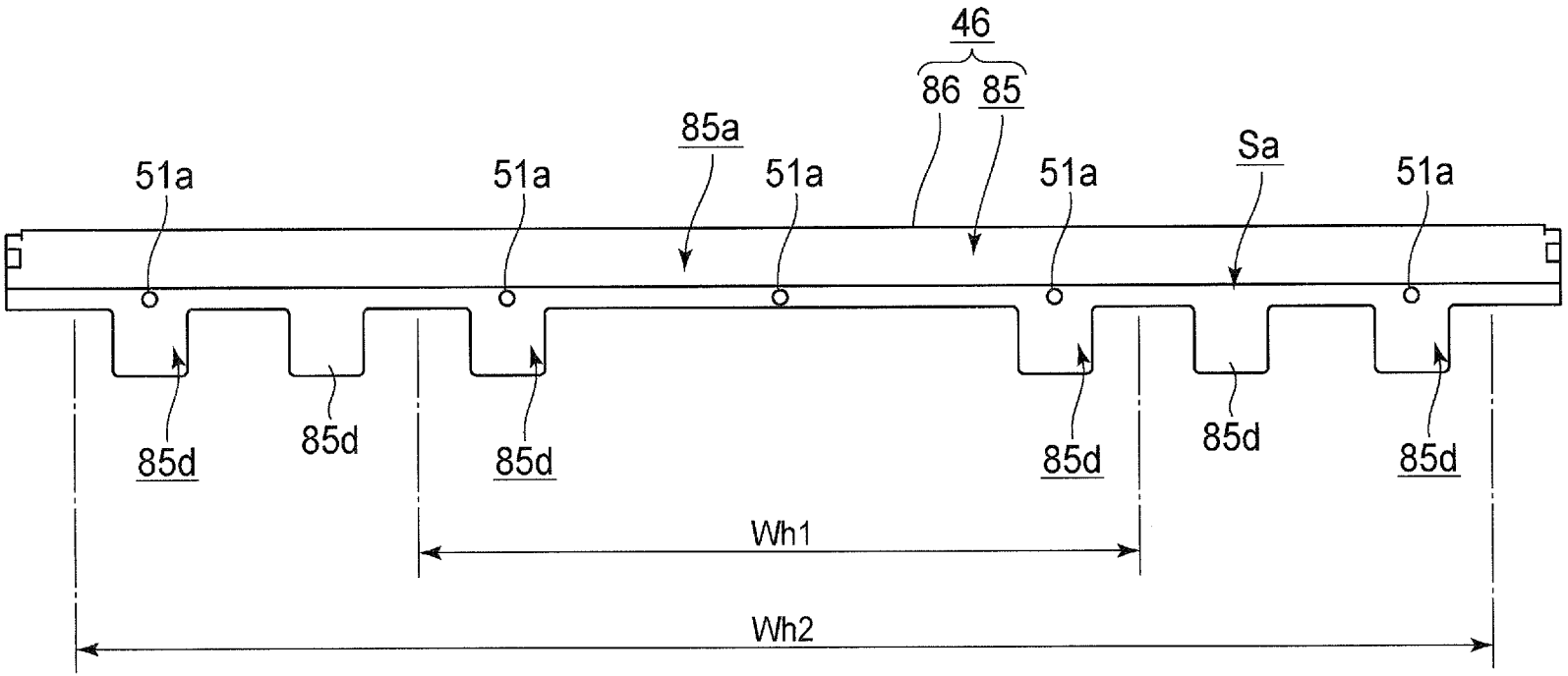
FIG. 8B is a rear view of the pressure pad according to the second embodiment.

FIG. 8B is a rear view of the pressure pad according to the second embodiment. The printer 10 according to the present invention supports A5, A4, and A3 size paper. Two laterally centered first lower half portions 85*d* are disposed within the width Wh2. Two laterally centered second lower half portions 85*d* are disposed between the two laterally centered first lower half portions 85*d*. Two laterally centered third lower half portions 85*d* are disposed between the two laterally centered second lower half portions 85*d*. Each of four projected surface 51*a* is formed on the surface Sa of the upper half portion 85*a* immediately above a corresponding one of the laterally centered first and third lower half portions 85*d*. One projected surface 51*a* is formed at the longitudinal middle of the upper half portion 85*a*. Each of four projected surfaces 53*a* is formed on the surface Sc of a corresponding one of two abutting members 52. When printing is performed on A5 size paper, the A5 size paper is advanced in the area Wh1. When printing is performed on A3 size paper, the A3 size paper is advanced in the area Wh2.

The projections 51 and 53 are formed of a heat resistant resin that can withstand the temperature at which the fixing unit 35 operates. The heat resistant resin is preferably electrically conductive so that the charges developed on the base member 85 can be dissipated. If the charges on the base member 85 can be conducted to surrounding members in some way, the projections 51 and 53 need not be formed of an electrically conductive resin.

In the second embodiment, the projected surface 51*a* is formed on the lower portion of the upper half portion 85*a*. Instead, the projected surface 51*a* may be formed at an arbitrary position on the surface of the lower half portion 85*d* that faces the inner wall 48*a*. For example, the projected surface 51*a* may be formed on the lower end portion of the lower half portions 85*d*.

In the second embodiment, the projected surface 51*a* is formed on the base member 85 and the projected surface 53*a* is formed on the abutting member 52. Instead, projections may be formed on the inner wall 48*a* of the holder 48 and the surface Sb of the lower half portion 85*d*.

The projected surface 51*a* reduces the area of the upper half portion 85*a* in contact with the inner wall 48*a* and the projected surface 53*a* reduces the area of the lower half portion 85*d* in contact with the abutting member 52. This configuration reduces the friction resistance developed between the pressure pad 46 and the holder 48 when the pressure pad 46 extends and retracts within the holder 48.

When the projected surfaces 51*a* and 53*a* formed of a resin material rub on the inner wall 48*a* and lower half portion 85*d*, respectively, the friction resistance between the pressure pad 46 and the holder 48 is relatively small. Even when the pressure pad 46 inclines, vibrates, or rattles, seizure of pressure pad will not occur in a high temperature environment, preventing damaged images, positional shifts of images, and uneven image quality that would otherwise lead to deteriorated image quality. Further, the load on the fixing motor that drives the fixing roller 37 is minimized, preventing complete stoppage of the fixing unit.

When the pressure pad 46 inclines, the lower end portion, i.e., projected surface 51*a* of the upper half portion 85*a* is pressed against the inner wall 48*a*, and the projected surface 53*a* of the abutting member 52 is pressed against the lower end portion of the lower half portion 85*d*. Therefore, the areas of the base member 85 in contact with the holder 48 and abutting member 52 may be sufficiently small. This further minimizes the friction resistance between the abutting member 52 and the pressure pad 46 and the friction resistance between the pressure pad 46 and the holder 48.

Third Embodiment

Elements similar to those of the first and second embodiments have been given the same reference numerals and their description is omitted.

Figure 9A:
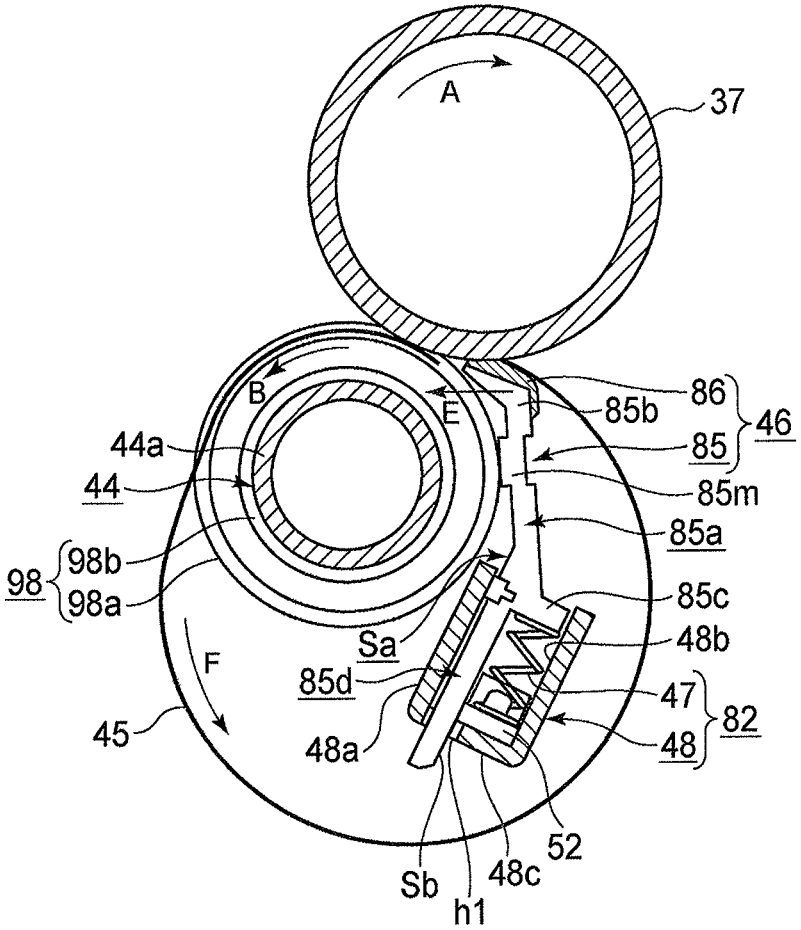
FIG. 9A is a cross-sectional view illustrating the pertinent portion of the fixing unit according to a third embodiment.
Figure 9B:
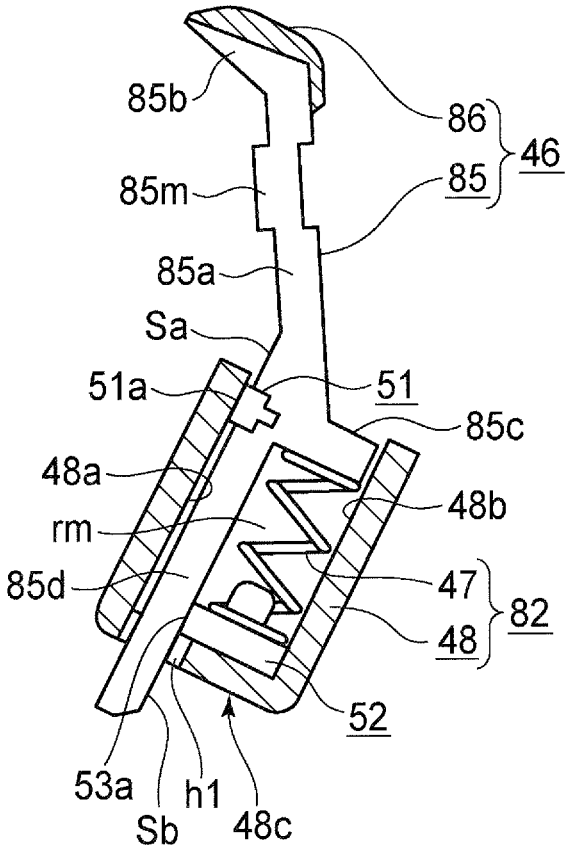
FIG. 9B is an expanded view of a pertinent portion of the fixing unit.
Figure 10:
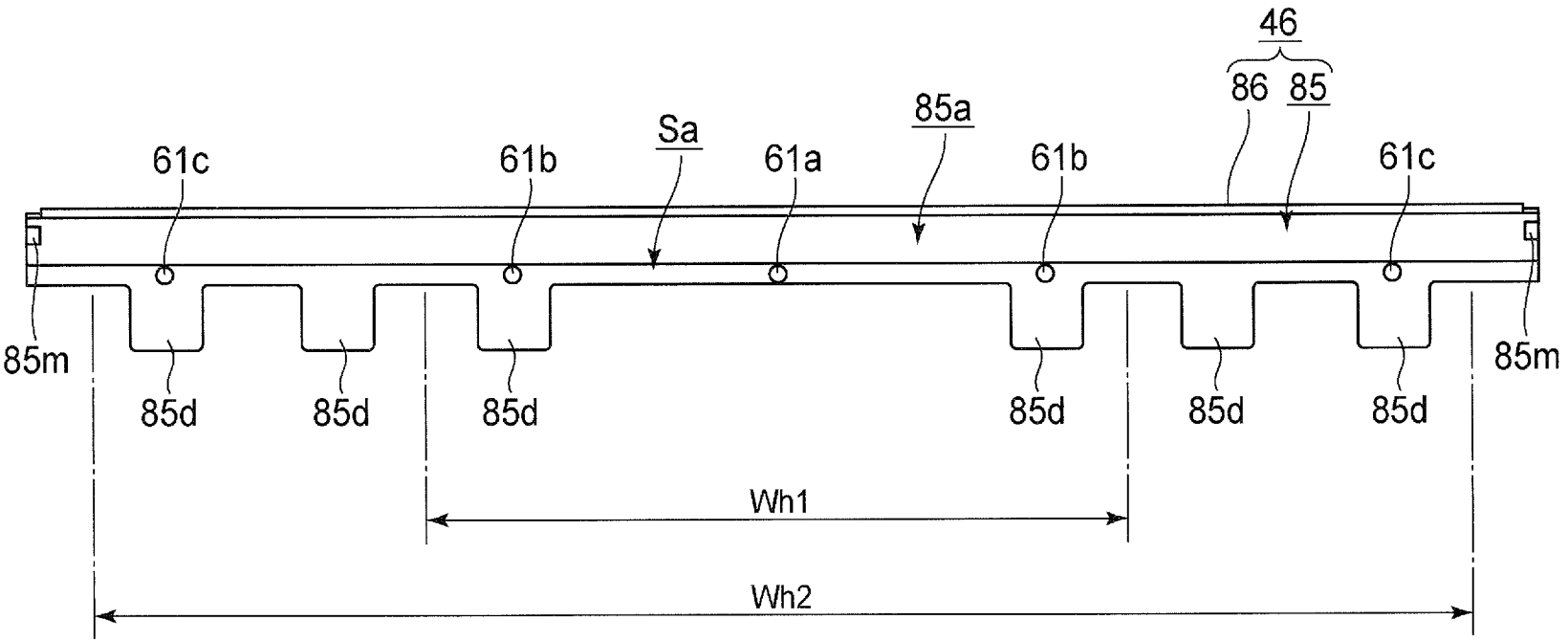
FIG. 10 is a rear view of a pressure pad according to the third embodiment.
Figure 11:
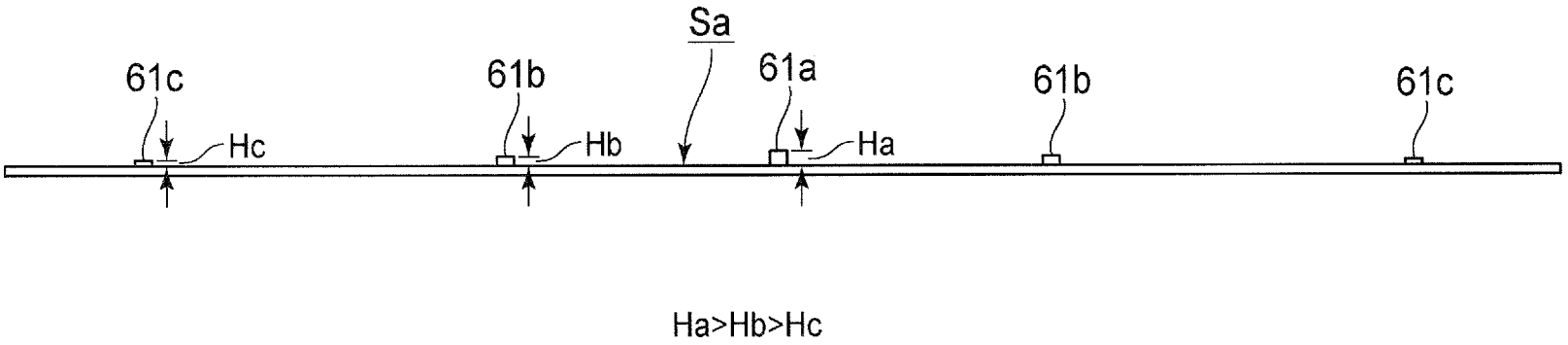
FIG. 11 is a cross-sectional view of the pressure pad.
Figure 12:
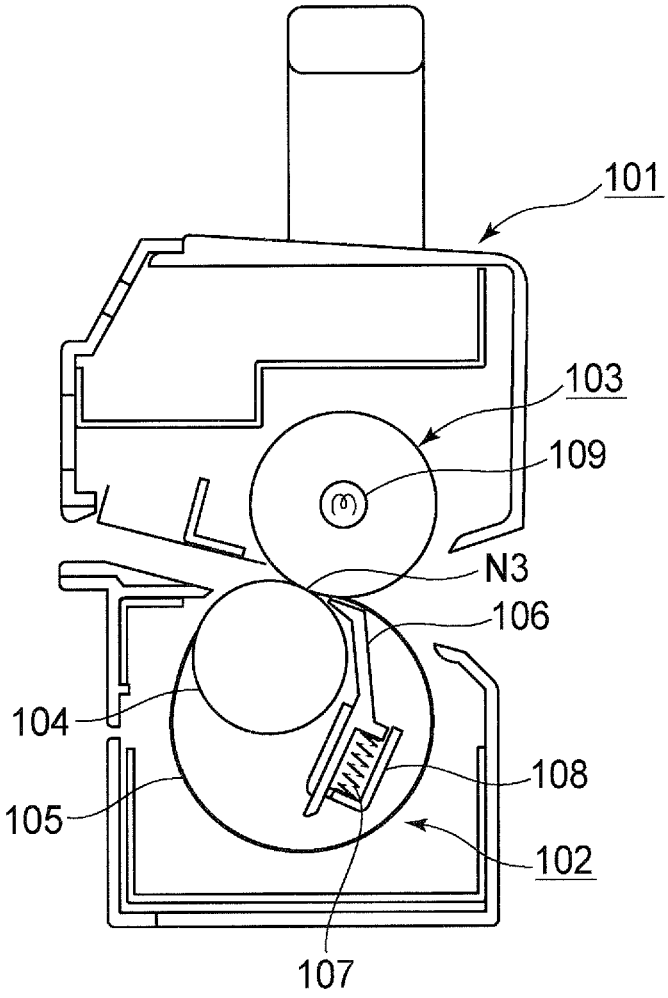
FIG. 12 CONVENTIONAL ART
FIG. 12 is a cross-sectional view of a conventional belt-nip fixing unit.

FIG. 9A is a cross-sectional view illustrating the pertinent portion of a fixing unit 35 according to a third embodiment. FIG. 9B is an expanded view of a pertinent portion of the fixing unit 35. FIG. 10 is a front view of a pressure pad according to the third embodiment. FIG. 11 is a cross-sectional view of anther pressure pad.

Referring to FIG. 9A, bearings 98 each include an outer race 98*a* and an inner race 98*b*. The shaft 44*a* of a pressure roller 44 is fitted into the inner race 98*b*.

Referring to FIG. 10, a plurality of projections 61*a*-61*c* in the shape of a cylinder are formed on a surface Sa of the base member 85, the surface Sa facing an inner wall 48*a* of a holder 48.

In order for the printer 10 to support a variety of paper sizes including A5, A4, and A3 sizes, the number of lower half portions 85*d* and projections 61-61*c* disposed along the longitudinal direction of the pressure pad 46 may be selected in accordance with the paper size to support.

In the third embodiment, the number of the lower half portions 85*d* and projections 61*a*-61*c* is selected to support a variety of paper sizes including A5, A4, and A3 sizes. Six lower half portions 85*d* are disposed within the width Wh2 of the paper. Two laterally centered first lower half portions 85*d* are disposed within the Wh2. Two laterally centered second lower half portions 85*d* are formed between the two laterally centered first lower half portions 85*d*. Two laterally centered third lower half portions 85*d* are formed between the two laterally centered second lower half portions 85*d*. One projection 61*a* is formed on the surface Sa and substantially at the longitudinal middle of the upper half portion 85*a*. Each of two projections 61*c* is formed on the surface Sa immediately above a corresponding one of the two laterally centered first lower half portions 85*d*. Each of another two projections 61*b* is formed on the surface Sa immediately above a corresponding one of the two laterally centered second lower half portions 85*d*. When printing is performed on A5 size paper, the A5 size paper is advanced in the area Wh1. When printing is performed on A3 size paper, the A3 size paper is advanced in the area Wh2.

The outer race 98*a* of the bearing 98 that rotatably supports the pressure roller 44 abuts projections 85*m* formed at both longitudinal end portions of the upper half portion 85*a*, creating a clearance between the pressure roller 44 and a pressing portion 85*b* of the base member 85 so that the base member 85 does not interfere with the pressure roller 44. Thus, the pressure pad 46 is supported at its longitudinal end portion by the projections 85*m*.

When the fixing roller 37 rotates in a direction shown by arrow A and the pressure belt 45 runs in a direction shown by arrow F, the friction resistance between the inner surface of the pressure belt 45 and the surface of the elastic layer 86 exerts a force on the pressure pad 46 that acts in a direction shown by arrow E. Since the pressure pad 46 is supported at its longitudinal end portions by the projections 85*m*, the lower end portion of the upper half portion 85*a* is firmly pressed against the inner wall 48*a* and the lower end portions of the lower half portions 85*d* are firmly pressed against the abutting member 52. The pressing force decreases with increasing distance from the longitudinal end portions of the pressure pad 46.

It is to be noted that if the pressure pad 46 fails to press the fixing roller 37 uniformly across the length of the fixing roller 37, non-uniform pressing force causes distorted images, shifted images, and uneven density of images, leading to degraded image quality.

In the third embodiment, the projections 61*a*-61*c* are formed with different heights from the surface Sa in accordance with the positions of the projections 61*a*-61*c* in the longitudinal direction. The projections 61*a*-61*c* are higher nearer the longitudinally middle portion of the pressure pad 46, and therefore lower further away from the middle portion. The heights of the projections 61*a*-61*c* are related as follows:

$$Ha>Hb>Hc$$

where Ha is the height of the projection 61*a*, Hb is the height of the projection 61*b*, Hc is the height of the projection 61*c*.

The selection of height of the projections 61*a*-61*c* allows the pressure pad 46 to press the fixing roller 37 uniformly across the length of the fixing roller 37, thus preventing distorted images, shifted images, and uneven density of images to provide good image quality.

The aforementioned configuration, in which the projections 61*a*-61*c* are higher nearer the middle portion of the pressure pad 46, may also be applied to the second embodiment.

The first to third embodiments have been described in terms of a tandem printer 10 that incorporates black, yellow, magenta and cyan image forming units aligned in tandem, the present invention may also be applied to a variety of image forming apparatus including a mono color printer, a copying machine, a facsimile machine, and a multifunction printer.

The invention is not limited to the described the embodiments, and may be modified in a variety of ways without departing from the scope of the invention.

What is claimed is:

1. A fixing apparatus, comprising:

a rotatably supported fixing member;

a first pressing member disposed to face the fixing member;

a running member sandwiched between the fixing member and the first pressing member, and running when the fixing member rotates;

a first pressing mechanism that urges the first pressing member against the fixing member so that a first nip is defined between the fixing member and the running member;

a second pressing member disposed to face the fixing member with the running member sandwiched between the fixing member and the second pressing member;

a second pressing mechanism that urges the second pressing member against the fixing member with the running member sandwiched between the fixing member and the second pressing member so that a second nip is defined between the fixing member and the running member, the second nip being adjacent to the first nip; and an abutting member received in the holding member and slidable within the holding member;

wherein the second pressing mechanism includes a holding member that holds the second pressing member and an urging member therein, the urging member urging the second pressing member against the fixing member; and wherein the second pressing member and the holding member abut each other through a plurality of projections formed on the abutting member.

2. The fixing apparatus according to claim 1, wherein when the running member runs, the second pressing member is pressed against the holding member through the projections.

3. The fixing apparatus according to claim 1, wherein at least one of the second pressing member and the holding member is formed of a metal material and the abutting member is formed of a resin material.

4. The fixing apparatus according to claim 3, wherein the resin material is electrically conductive.

5. The fixing apparatus according to claim 1, wherein the projections are formed in one piece with at least one of the second pressing member and the holding member.

6. An image forming apparatus incorporating the fixing apparatus according to claim 1, the image forming apparatus further comprising:

at least one image forming section that forms a developer image on an image bearing body; and a transfer device that transfers the developer image onto a medium.

7. The fixing apparatus according to claim 1, wherein the abutting member abuts the urging member and includes a projected surface that is slidable on the second pressing member.

8. The fixing apparatus according to claim 7, wherein the second pressing member comprises a base member and an elastic member, the base member including:

a first half portion on which the elastic member is mounted, a second half portion contiguous with the first half portion and in contact with the projected surface, an abutting portion located proximate an area between the first half portion and the second half portion and abutting one end of the urging member, and a first projection formed proximate the abutting portion and slidable on the holding member;

wherein, when the running member runs, the first projection slides on the holding member and the projected surface slides on the second half portion.

9. The fixing apparatus according to claim 8, wherein the first projection and the base member are two separate members, assembled together, and the second projection and the abutting member are two separate members, assembled together.

10. A fixing apparatus, comprising:

a rotatably supported fixing member;

a first pressing member disposed to face the fixing member:, a running member sandwiched between the fixing member and the first pressing member, and running when the fixing member rotates;

a first pressing mechanism that urges the first pressing member against the fixing member so that a first nip is defined between the fixing member and the running member;

a second pressing member disposed to face the fixing member with the running member sandwiched between the fixing member and the second pressing member; and a second pressing mechanism that urges the second pressing member against the fixing member with the running member sandwiched between the fixing member and the second pressing member so that a second nip is defined between the fixing member and the running member, the second nip being adjacent to the first nip;

wherein:

the second pressing mechanism includes a holding member that holds the second pressing member and an urging member therein, the urging member urging the second pressing member against the fixing member;

the second pressing member and the holding member abut each other through a plurality of projections formed on at least one of the second pressing member and the holding member;

the fixing member longitudinally extends in a first direction the second pressing member longitudinally extends in a second direction substantially parallel to the first direction, and the plurality of projections are aligned in the second direction and have different heights from one another.

11. The fixing apparatus according to claim 10, wherein the plurality of projections have larger heights nearer a longitudinal middle of the fixing member.

12. The fixing apparatus according to claim 10, wherein the second pressing mechanism comprises an abutting member that is received in the holding member and abuts the urging member, the abutting member including a projected surface that is slidable on the second pressing member.

13. The fixing apparatus according to claim 12, wherein the second pressing member comprises a base member and an elastic member, the base member including:

a first half portion on which the elastic member is mounted, a second half portion contiguous with the first half portion and in contact with the projected surface, an abutting portion located proximate an area between the first half portion and the second half portion and abutting one end of the urging member, and a first projection formed proximate the abutting portion and slidable on the holding member;

wherein, when the running member runs, the first projection slides on the holding member and the projected surface slides on the second half portion.

14. The fixing apparatus according to claim 13, wherein the first projection and the base member are two separate members, assembled together, and the second projection and the abutting member are two separate members, assembled together.

15. An image forming apparatus incorporating the fixing apparatus according to claim 10, the image forming apparatus further comprising:

at least one image forming section that forms a developer image on an image bearing body; and a transfer device that transfers the developer image onto a medium.

16. The fixing apparatus according to claim 10, wherein the second pressing member is pressed against the holding member through the projections when the running member runs.

17. The fixing apparatus according to claim 10, wherein at least one of the second pressing member and the holding member is formed of a metal material.

18. The fixing apparatus according to claim 17, wherein the abutting member is formed of an electrically conductive resin material.

19. The fixing apparatus according to claim 10, wherein the projections are formed in one piece with at least one of the second pressing member and the holding member.

* * * * *